United States Patent [19]

Harlow

[11] 4,234,759

[45] Nov. 18, 1980

[54] MINIATURE COAXIAL CABLE ASSEMBLY

[75] Inventor: Norman R. Harlow, Central Valley, N.Y.

[73] Assignee: Carlisle Corporation, Buchanan, N.Y.

[21] Appl. No.: 29,119

[22] Filed: Apr. 11, 1979

[51] Int. Cl.[3] ..... H01B 7/08

[52] U.S. Cl. ..... 174/104; 174/103; 174/106 R; 174/115; 174/117 F

[58] Field of Search ..... 174/103, 104, 106 R, 174/115, 117 F, 105 R

[56] References Cited

U.S. PATENT DOCUMENTS

| | | | |
|---|---|---|---|
| 3,673,315 | 6/1972 | Lasley | 174/115 X |
| 3,775,552 | 11/1973 | Schumacher | 174/105 R |
| 3,816,644 | 6/1974 | Giffel | 174/115 |
| 3,927,247 | 12/1975 | Timmons | 174/115 X |
| 4,155,613 | 5/1979 | Brandeau | 174/117 F X |

FOREIGN PATENT DOCUMENTS

| | | | |
|---|---|---|---|
| 414713 | 8/1934 | United Kingdom | 174/117 F |

*Primary Examiner*—Richard R. Kucia

*Attorney, Agent, or Firm*—Brooks, Haidt, Haffner & Delahunty

[57] ABSTRACT

A flat coaxial cable assembly comprising a plurality of parallel coaxial cables disposed in coplanar configuration, each cable being self-contained and with a center conductor, dielectric material around the conductor and a shield of conductive material around the dielectric material, a plurality of drain wires disposed between alternate pairs of adjacent coaxial cables, the drain wires having conductive contact with the shields of the pair of adjacent cables, and a sheath of insulating material encasing the cables and the drain wires with portions thereof on opposite sides of the cables bonded together by way of the spaces between the cables where the drain wires are omitted and at the sides of the outermost cables.

9 Claims, 1 Drawing Figure

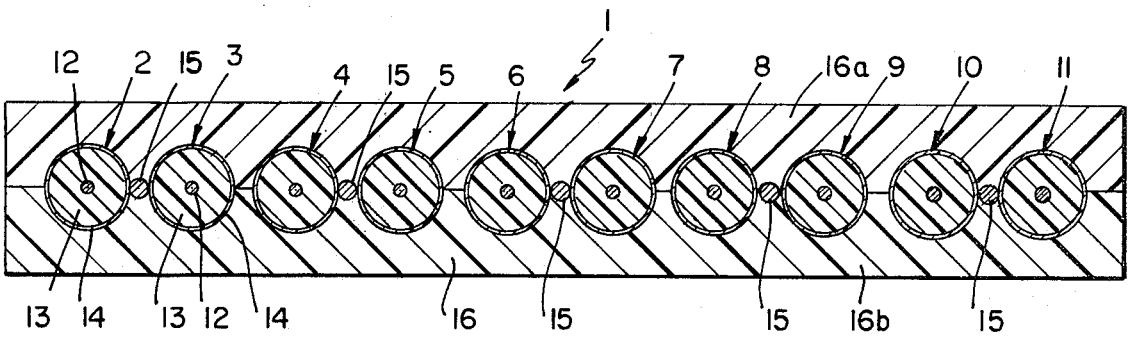
1
12
2
15
3
4
15
5
6
7
8
16a
9
10
11
13
14
13
12
14
16
15
15
16b
15

MINIATURE COAXIAL CABLE ASSEMBLY

The invention relates to a flexible flat cable assembly comprising a plurality of coaxial cables with individual drain wires between alternate pairs of adjacent cables, the cables and wires being encased by insulating material and the cables being located on precisely located center spacings.

U.S. Pat. No. 3,775,552 discloses a flat cable assembly comprising a plurality of coaxial cables and intermediate drain wires sandwiched between layers of conductive material, such as metal foil, and covered by electrical insulation material. The patent also discloses coaxial cables each with an encircling metal sheath or shield with a drain wire within the sheath, the whole being covered by a layer of insulating material. In each case, the layers of conductive material are bonded to each other or to the drain wires intermediate the coaxial cables or the space between the coaxial cables is filled with insulating material.

Said patent indicates that the structure disclosed therein is suitable for miniaturized coaxial cable assemblies, but it must be borne in mind that the conductors of such assemblies must connect with connectors which have terminals with a fixed spacing. The structures disclosed in said patent are satisfactory when the spacing between the terminals, and hence, between the center conductors of the coaxial cables, is 0.100 inches or more, but a demand for a spacing between the center conductors of 0.050 inches has arisen. It has been found that the structures disclosed in said patent are not satisfactory for providing cable assemblies with a spacing of about 0.050 inches between the center conductors, a spacing about half of the previously required spacing, because there is insufficient space between the coaxial cables to permit adequate bonding of the top and bottom layers of conductive material or insulating material to each other. In addition, when the connector terminals are a standard 0.025 inches apart and bearing in mind that the coaxial cable insulation standard diameter is about 0.034 inches, the spacing between the center conductors and the center of the drain wires, with the structure shown in FIG. 4 of said patent will be less than 0.025 inches which requires "fanning out" of the drain wires to connect the conductors to the terminals. For these reasons, the structures disclosed in said patent are not entirely satisfactory for cable assemblies in which the conductors of the coaxial cables are spaced apart 0.050 inches and the connector terminals are spaced apart 0.025 inches.

One object of the invention is to provide a miniaturized cable assembly comprising coaxial cables and drain wires enclosed by insulating material and which, when the distance between the center conductors of the cables is less than 0.100 inches, provides adequate bonding of the insulating layers to each other intermediate the coaxial cables and without bonding of such layers to the shields of the coaxial cables.

A further object of the invention is to provide such a cable assembly in which the spacing between the cable conductors and the drain wires corresponds to the spacing between the terminals of a standard connector.

In accordance with the preferred embodiment of the cable assembly of the invention, the center conductors of the coaxial cables are spaced apart by the desired spacing, e.g. 0.050 inches, which, with the standard coaxial cable insulation outside diameter of 0.034 inches, leaves a space of 0.016 inches between the insulation or dielectric of the coaxial cables. The insulation of each cable is surrounded by a shield of conductive material, for example, an aluminum foil having a film of a plastic material, e.g. a polyester, bonded to its face facing toward the conductor. A drain wire is disposed between alternate adjacent pairs of cables in conductive contact with the shields of the adjacent cables. Thus, the drain wires are omitted between every other adjacent pairs of cables. The sum of the thickness of the shield and the diameter of the drain wire is at least equal to the spacing between the dielectric of the adjacent cables. In this way, the spacing between a center conductor and a drain wire is equal to one-half the spacing between the center conductors of adjacent cables, and a covering insulation or sheath which is applied over the cables and drain wires has sufficient space between every other adjacent pair of cables to provide an adequate bond between the top portion and the bottom portion of the insulation. The covering insulation can also be bonded to the drain wires, but it is unnecessary that it bond to the cable shields. Also, with the structure of the invention, the drain wires can have a diameter larger than the diameter of wires previously used, even though the center conductors of the cables are closer than in the prior art, which has the advantage that the direct current resistance of such drain wires is less.

Other objects and advantages of the present invention will be apparent from the following detailed description of the presently preferred embodiments thereof, which description should be considered in conjunction with the single FIGURE of the accompanying drawing which is a cross-section of a preferred embodiment of the invention.

The cable assembly 1 illustrated in the drawing comprises a plurality of similar coaxial cables 2–11. Each cable 2–11 has a central conductor 12 with a dielectric covering 13 therearound which, in turn, is covered by a shield 14 contacting the entire periphery of the covering 13. The shield 14 can be an aluminum foil bonded to a polyester film, such as MYLAR, with the film intermediate the foil and the center conductor 12 or can be a high conductivity metal, such as aluminum or copper, plated on the dielectric covering 13. The dielectric covering 13 can be any conventional material, such as a foamed polypropylene.

Drain wires 15, which can be tin plated copper wires, are disposed between alternate adjacent pairs of cables 2–11 and are omitted between every other adjacent pair of cables. Thus, there is a drain wire 15 between each of the cable pairs 2–3, 4–5, 6–7, 8–9 and 10–11 but drain wires 15 are omitted from between the cables 3 and 4, 5 and 6, 7 and 8 and 9 and 10. In other words, the drain wires 15 alternately fill and are omitted from the spaces between the cables 2–11. The drain wires 15 conductively contact the shields 14 of adjacent cables, and the cross-sectional dimension thereof is at least equal, and preferably slightly greater than, the spacing between the shields 14 of the adjacent cables. The thickness two shields 14 plus the cross-sectional dimension of a drain wire 15 is at least equal to the spacing between the dielectric covering 13 of the cables adjacent to the wire 15. As will be apparent from the drawing, each cable 2–11 is conductively connected to a drain wire 15.

Preferably, the cables 2–11 and the wires 15 are parallel to each other, the longitudinal axes of the conductors 12 are coplanar and the longitudinal axes of the wires 15 lie in the plane of the conductors 12. Also, the wires 15 are equally spaced from the conductors 12 of the adjacent cables.

As a specific example of an embodiment of a miniaturized cable assembly of the invention suitable for use with connectors having terminals spaced 0.025 inches apart, the cables 2–11 and drain wires 15 may have the following dimensions:

| Element | Dimension |
|---|---|
| Conductor 12 | Outside diameter 0.0071 in. |
| Dielectric 13 | Outside diameter 0.038 in. |
| Shield 14 | Outside diameter 0.03935 in. |
| Drain wire 15 | Outside diameter 0.0113 in. |
| Spacing between conductors 12 | 0.050 in. |
| Spacing between wire 15 and conductors 12 | 0.025 in. |
| Spacing between shields 14 | 0.01065 in. |

The cables 2–11 and the wires 15 are encased or embedded in a sheath 16 of an insulating plastics material, preferably an elastomeric material. The sheath 16 has a width greater than the width of the space occupied by the cables 2–11, is thin relative to its width and has flat upper and lower surfaces. Accordingly, the assembly 1 is a flat, flexible cable assembly.

The material of the sheath 16 can be extruded over the cables 16 and the wires 15 in a conventional manner or may be applied thereto as a pair of tapes as described in said U.S. Pat. No. 3,775,552. In either case, the upper portion **16*a* and the lower portion 16*b* are secured or bonded together alongside the outermost cables 2 and 11 and intermediate the cables 3 and 4, 5 and 6, 7 and 8 and 9 and 10 so that the conductors 12 of the cables 2–11 and the wires 15 are on precisely located center spacings and so that the sheath 16 is not merely an encircling envelope. Although permissible, it is not necessary that the materials of the shields 14, the wires 15 and the sheath 16 be such that the sheath will bond to the shields 14 and the wires 15 when the sheath 16 is applied. However, if desired, the materials may be selected, in a known manner, so that the sheath 16 will bond at least to the wires 15**.

The cable assembly 1 illustrated in the drawing includes five pairs of coaxial cables, but it can include a greater or lesser number of pairs of coaxial cables. In accordance with the invention, the cable assembly includes at least two pairs of coaxial cables.

Although preferred embodiments of the present invention have been described and illustrated, it will be apparent to those skilled in the art that various modifications may be made without departing from the principles of the invention.

I claim:

1. A flat coaxial cable assembly comprising: a plurality of parallel and spaced coaxial cables, each said cable comprising a center conductor individually surrounded by a dielectric covering which, in turn, is surrounded by an individual conductive shield in contact with the dielectric covering around its periphery; a plurality of drain wires disposed between alternate adjacent pairs of said cables and parallel thereto, each said wire being in conductive contact with the exterior surfaces of the shields of the pair of cables adjacent thereto, whereby said drain wires are omitted between every other pair of adjacent cables leaving a space therebetween; and a sheath of insulating material encasing said cables and said drain wires, insulating material of said sheath extending from one surface of said assembly to the other surface thereof intermediate pairs of cables not having a drain wire therebetween.

2. A cable assembly as set forth in claim 1 wherein the cross-sectional dimension of said drain wires is at least equal to the spacing between the shields of the cables adjacent thereto.

3. A cable as set forth in claims 1 or 2 wherein the longitudinal axes of said center conductors are coplanar.

4. A cable assembly as set forth in claim 3 wherein the longitudinal axes of the drain wires lie in the plane of said center conductors.

5. A cable assembly wherein said sheath is wider than the width of the cables therein, and is thin relative to its width and has flat exterior surfaces to provide a flat cable assembly and wherein said sheath comprises two tapes of a plastic material bonded together at the sides of the outermost cables and intermediate pairs of cables not having drain wires therebetween.

6. A cable assembly as set forth in claims 1 or 2 wherein each said shield is a thin layer of a metal applied completely around and in contact with the dielectric material.

7. A cable assembly as set forth in claim 6 wherein each said shield is a metal plating.

8. A cable assembly as set forth in claims 1 or 2 wherein each said shield is a metal foil adhesively bonded to a film of a plastic material, said film being intermediate the foil and the dielectric material.

9. A cable assembly as set forth in claims 1 or 2 wherein each drain wire is equally spaced from the center conductors of the adjacent cables.

* * * * *